US007717674B2

(12) United States Patent
Tsuji et al.

(10) Patent No.: US 7,717,674 B2
(45) Date of Patent: May 18, 2010

(54) CEILING FAN

(75) Inventors: Masao Tsuji, Mesa, AZ (US); Hadi Srass, Rancho Cucamonga, CA (US); James Holcomb, Sierra Madre, CA (US)

(73) Assignee: Hunter Fan Company, Memphis, TN (US)

( * ) Notice: Subject to any disclaimer, the term of this patent is extended or adjusted under 35 U.S.C. 154(b) by 454 days.

(21) Appl. No.: 11/593,246

(22) Filed: Nov. 6, 2006

(65) Prior Publication Data

US 2008/0107528 A1 May 8, 2008

(51) Int. Cl.
*F21V 33/00* (2006.01)

(52) U.S. Cl. ..... 416/5; 416/247 R

(58) Field of Classification Search ..... 416/5, 416/247 R; D23/385, 414, 412; 362/149
See application file for complete search history.

(56) References Cited

U.S. PATENT DOCUMENTS

| | | | | | |
|---|---|---|---|---|---|
| 332,821 | A * | 12/1885 | Murray, Jr. | ..... | 416/5 |
| 2,581,185 | A * | 1/1952 | Gordon | ..... | 416/5 |
| 4,064,427 | A * | 12/1977 | Hansen et al. | ..... | 416/5 |
| 4,515,538 | A * | 5/1985 | Shih | ..... | 416/5 |
| 4,657,485 | A * | 4/1987 | Hartwig | ..... | 416/5 |
| 4,750,863 | A * | 6/1988 | Scoggins | ..... | 416/5 |
| 5,292,228 | A * | 3/1994 | Dye | ..... | 416/5 |
| 5,528,469 | A * | 6/1996 | Todd, Jr. | ..... | 362/294 |
| 5,672,002 | A * | 9/1997 | Todd, Jr. | ..... | 362/294 |
| 6,240,247 | B1 | 5/2001 | Reiker | | |
| 6,366,733 | B1 | 4/2002 | Reiker | | |
| 6,438,322 | B1 | 8/2002 | Reiker | | |
| 6,477,321 | B2 | 11/2002 | Reiker | | |
| 6,676,375 | B2 * | 1/2004 | Steeves LeBlanc et al. | .... | 416/5 |
| D533,653 | S * | 12/2006 | Hidalgo | ..... | D23/385 |

FOREIGN PATENT DOCUMENTS

WO WO 9408142 A1 * 4/1994

* cited by examiner

*Primary Examiner*—Richard Edgar
(74) *Attorney, Agent, or Firm*—Baker Donelson

(57) ABSTRACT

A ceiling fan (10) is disclosed having a motor (13) and motor housing (11) suspended from a ceiling by a downrod (12). The motor rotatably drives an annular array of blades (15). The ceiling fan also includes a tubular screen or shroud (20) mounted about the motor housing and blades so as to substantially conceal a large portion of these components from view. The shroud includes an annular lower mounting plate (21) and an annular side wall (23) extending upwardly from the lower plate. The side wall is formed of a series of candles (24) having the appearance of flickering wicks (25) through incandescent bulbs. The lower plate is coupled to the downrod through a coupler (27) and a series of first arms (28).

10 Claims, 6 Drawing Sheets

CEILING FAN

TECHNICAL FIELD

This invention relates to fans, and specifically to ceiling fans.

BACKGROUND OF THE INVENTION

Fans, and especially ceiling fans, have become an increasingly popular supplementary means of conditioning air within both commercial and residential buildings. However, many people do not like or appreciate the appearance of a ceiling fan within a room and would prefer to have a ceiling fan that is unobtrusive or obscured from view.

Accordingly, it is seen that a need exists for a ceiling fan that does not have the outward appearance of a ceiling fan. It is to the provision of such therefore that the present invention is primarily directed.

SUMMARY OF THE PRESENT INVENTION

In a preferred form of the invention, a ceiling fan comprises a motor, a motor housing encasing the motor, a plurality of blades coupled to the motor, and a shroud positioned about the motor housing and plurality of blades. The shroud includes a lower plate and a screen extending upwardly from the lower plate. With this construction, the shroud obscures the motor housing and plurality of blades from view along a line of sight.

DETAILED DESCRIPTION

Figure 1:
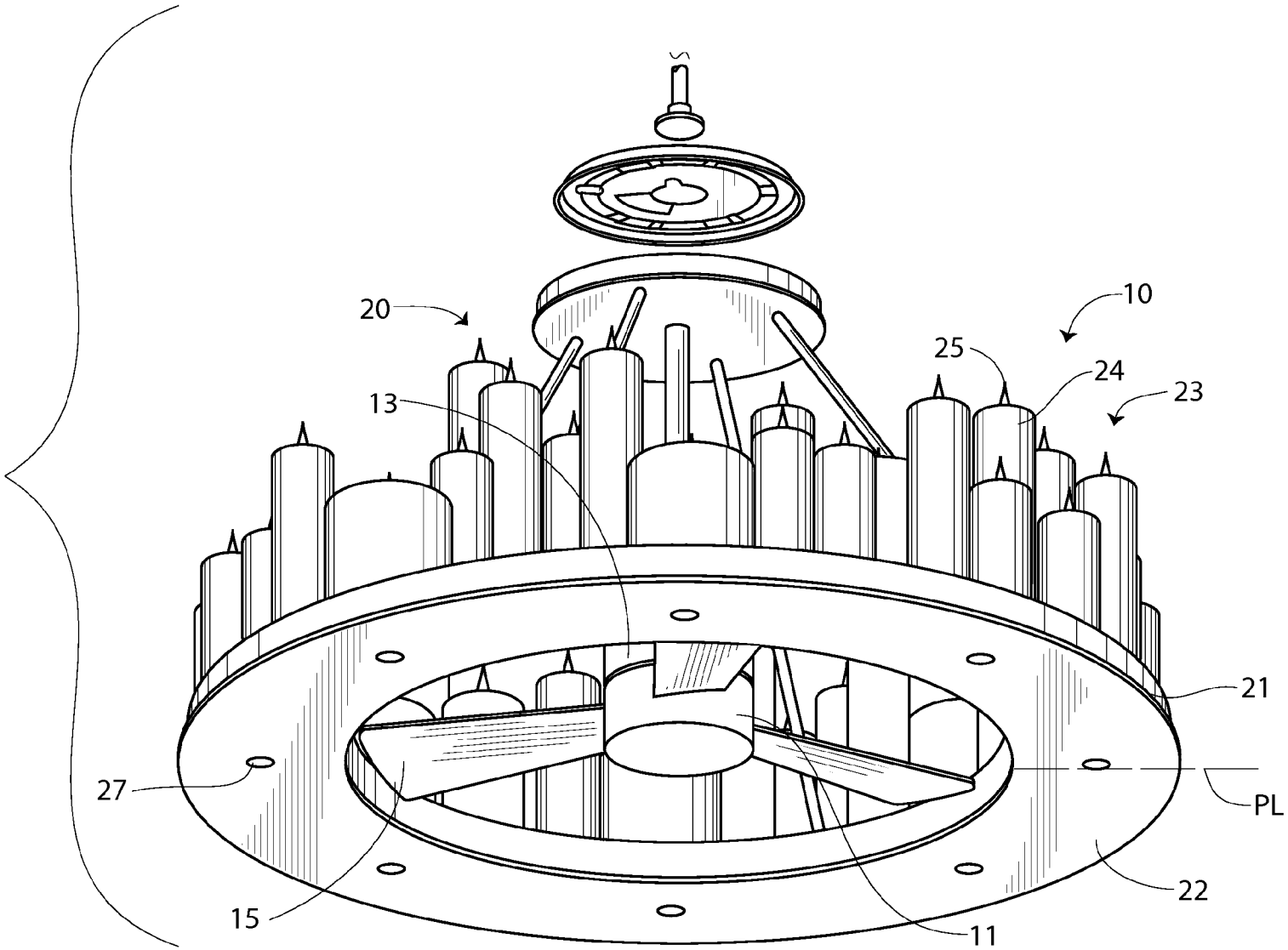
FIG. 1 is a perspective view of a ceiling fan that embodies principles of the invention in its preferred form, shown in a position mounted to a ceiling.
Figure 2:
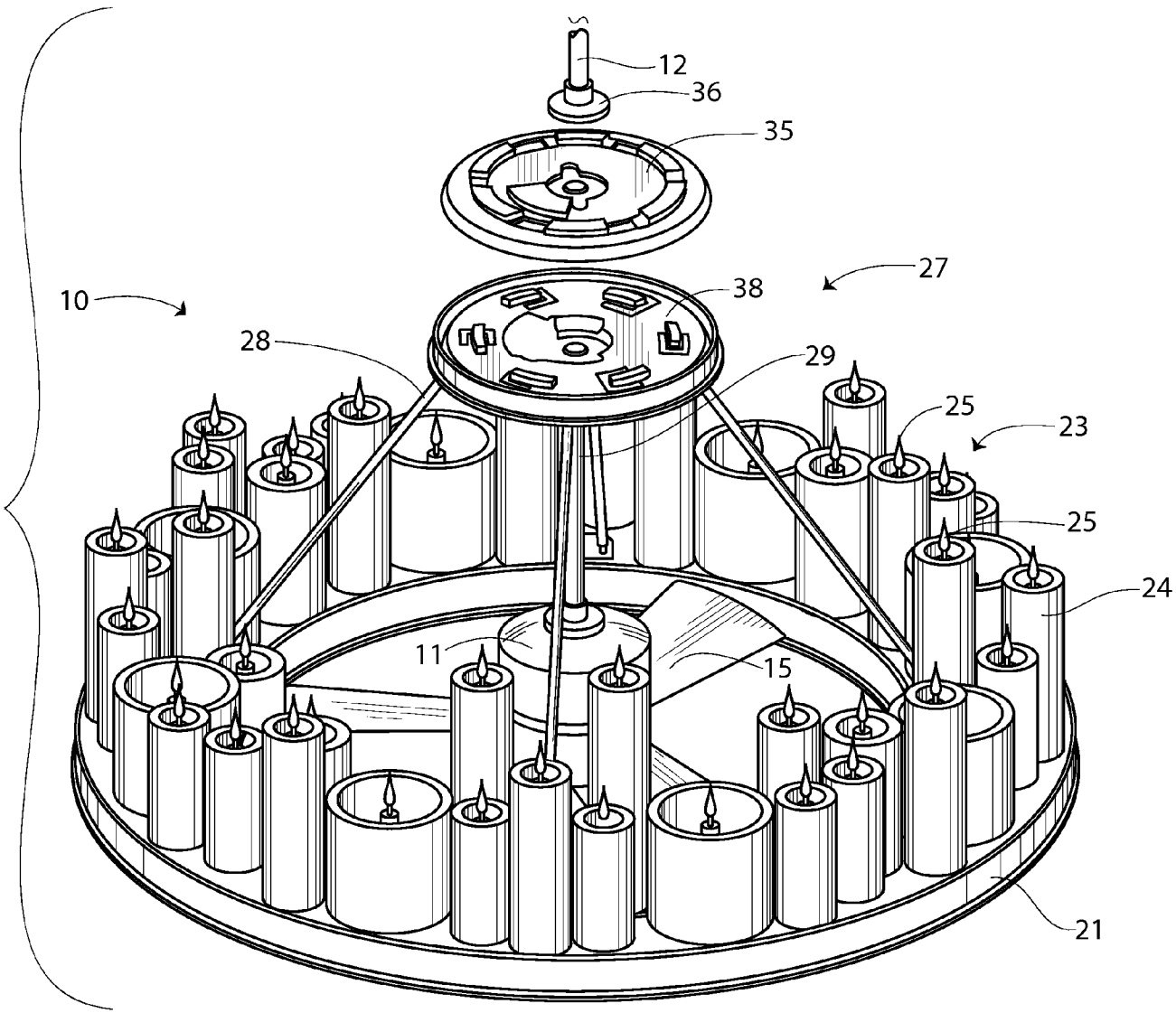
FIG. 2 is a perspective view of the ceiling fan shown in FIG. 1.
Figure 3:
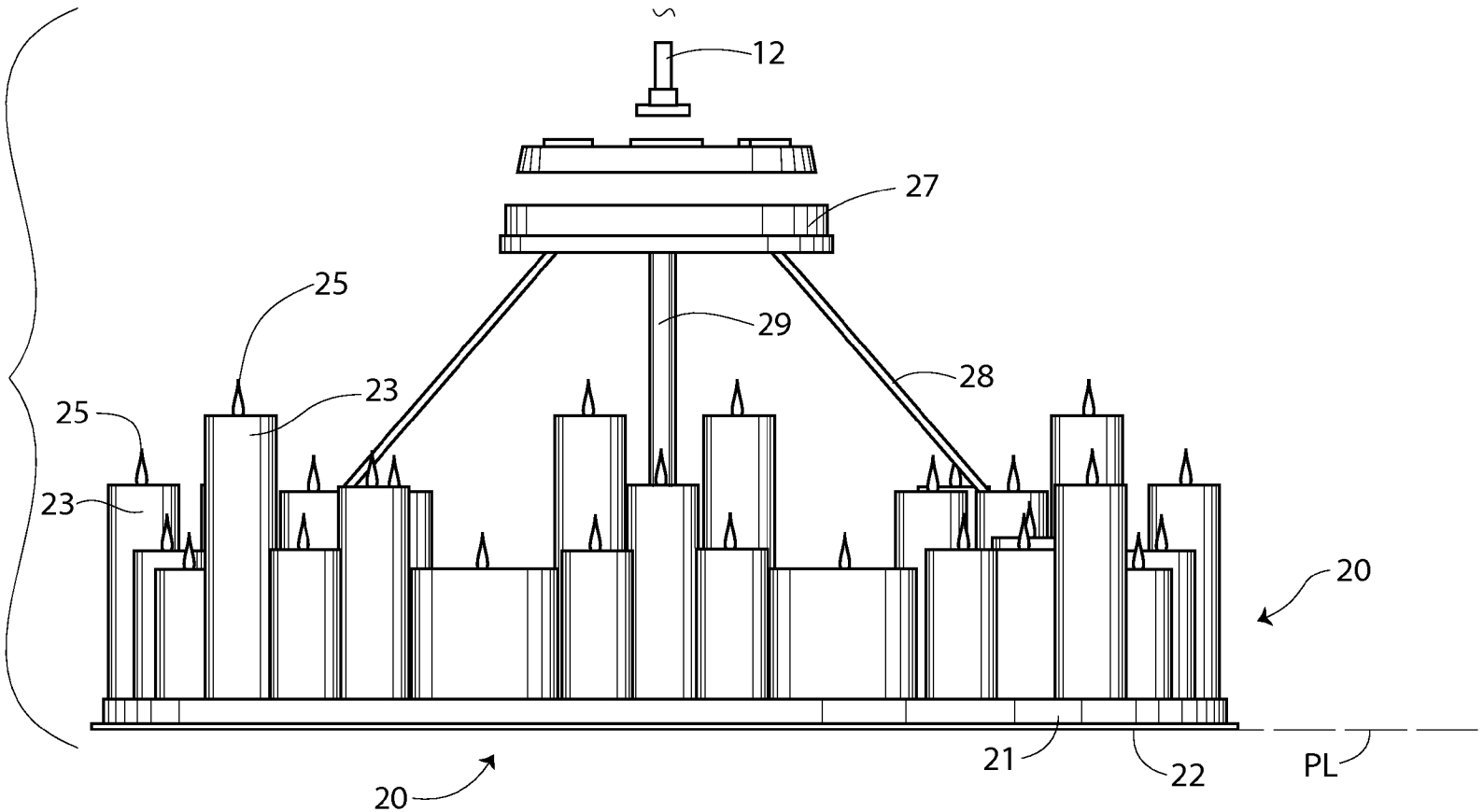
FIG. 3 is a side view of a ceiling fan shown in FIG. 1.
Figure 4:
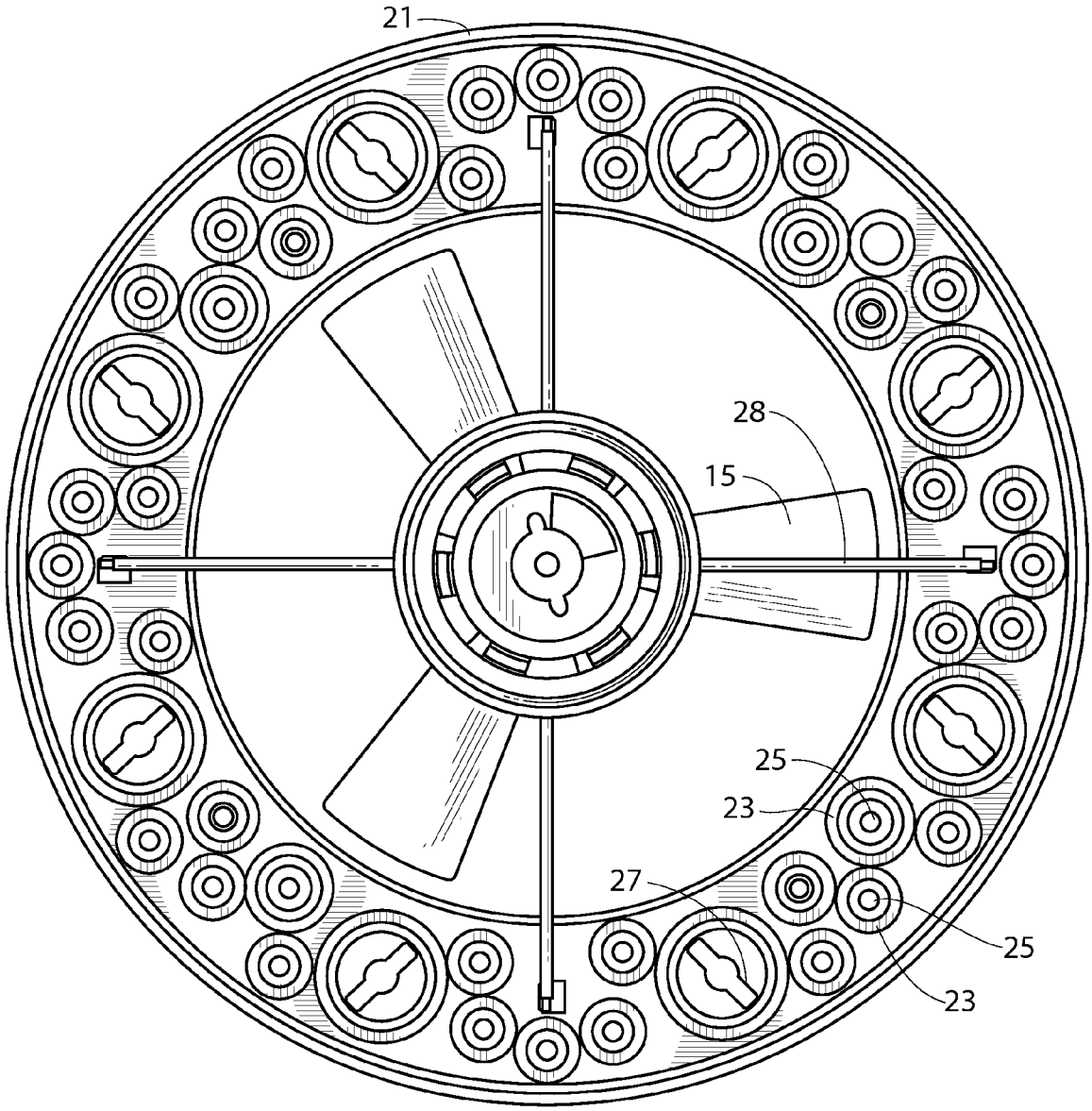
FIG. 4 is a top view of the ceiling fan of FIG. 1.

With reference next to the drawings, there is shown a ceiling fan 10 having a motor housing 11 suspended from a ceiling by a downrod 12. An electric motor 13 is mounted within the housing 11 and connected to a source of electric power by electrical wires that extend through the downrod 12. The motor rotatably drives an annular array of blades 15 oriented generally along an annular array of radial lines extending radially from the center or center axis of the motor.

The ceiling fan 10 also includes a tubular screen or shroud 20 positioned about the motor housing 11 and blades 15 so as to substantially conceal a large portion of these components from view. The shroud of the preferred embodiment includes an annular lower mounting plate 21, having a bottom surface 22 oriented along a plane PL, and an annular side wall 23 extending upwardly from the lower plate 21. The side wall 23 is formed of a series of imitation candles 24 having the appearance of flickering wicks 25 through incandescent bulbs of the type shown in U.S. Pat. Nos. 4,550,363 and 4,551,794, the teachings of which are specifically incorporated herein. The lower plate 21 may include a series of down-lights 27 therein which are also coupled to the electrical wires that provide power. The lower plate 21 is coupled to the downrod 12 through a mounting plate or coupler 27 coupled to the bottom end of the downrod and from which a first series of struts or arms 28 extend to the lower plate 21. The motor or motor housing is coupled to the lower plate 21 through a secondary downrod 29 aligned with the downrod 12. The coupler 27 includes a top mounting plate 35 having an internally threaded downrod receiver 36 and a bottom mounting plate 38 from which the secondary downrod 29 depends. The top mounting plate 35 and bottom mounting plate 38 are configured to rotatably mate with each other.

In use, the downrod 12 is coupled to the ceiling with the top mounting plate 35 coupled to the opposite end of the downrod. The motor and shroud are coupled to the downrod 12 by rotatably mounting the bottom mounting plate 38 to the top mounting plate 35. Once the motor 13 is electrically energized its rotation causes the blades to rotate generally about the center or central axis of the motor.

A large portion of the ceiling fan motor housing and blades is obscured from view by the shroud 20 along certain lines of sight, those lines of sight being generally to an angle towards the side of the ceiling fan as the ceiling fan may still be partially viewed from a position below it. As such, it is preferred that the lower plate bottom surface 22 be positioned below the level of the blades 15.

It is believed that the shroud not only masks the appearance of a conventional ceiling fan, but that it also may aid in reducing noise associated with the ceiling fan, as the shroud acts to block noise produced by the motor and rotating blades.

Figure 5:
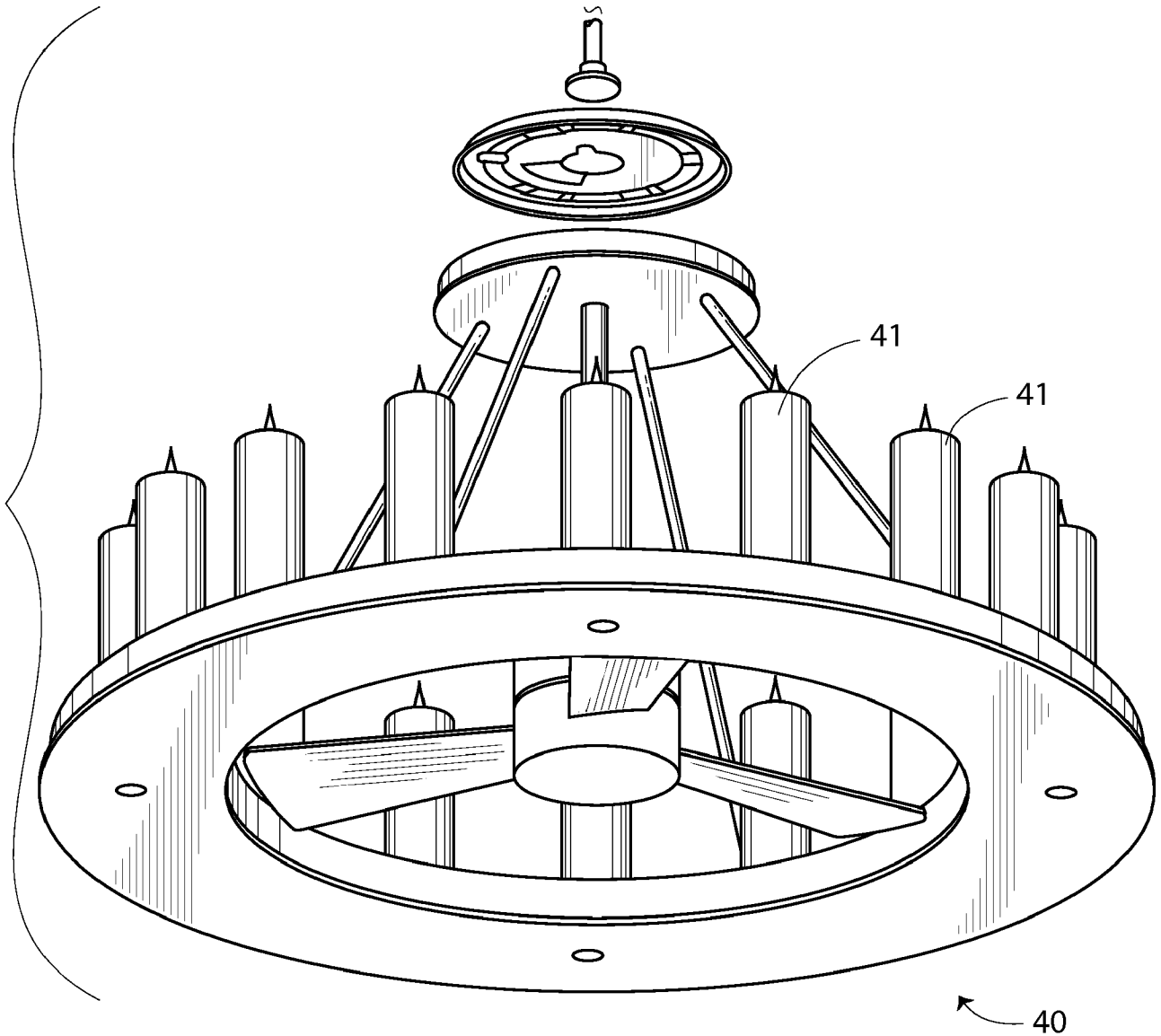
FIG. 5 is a perspective view of the shroud portion of a ceiling fan in another preferred form of the invention.

With reference next to FIG. 5, there is shown a ceiling fan shroud 40 in another preferred form of the invention. Here, the ceiling fan shroud 30 is essentially the same as that previously described except for the number and spacing of the candles 41 which comprise the side wall.

Figure 6:
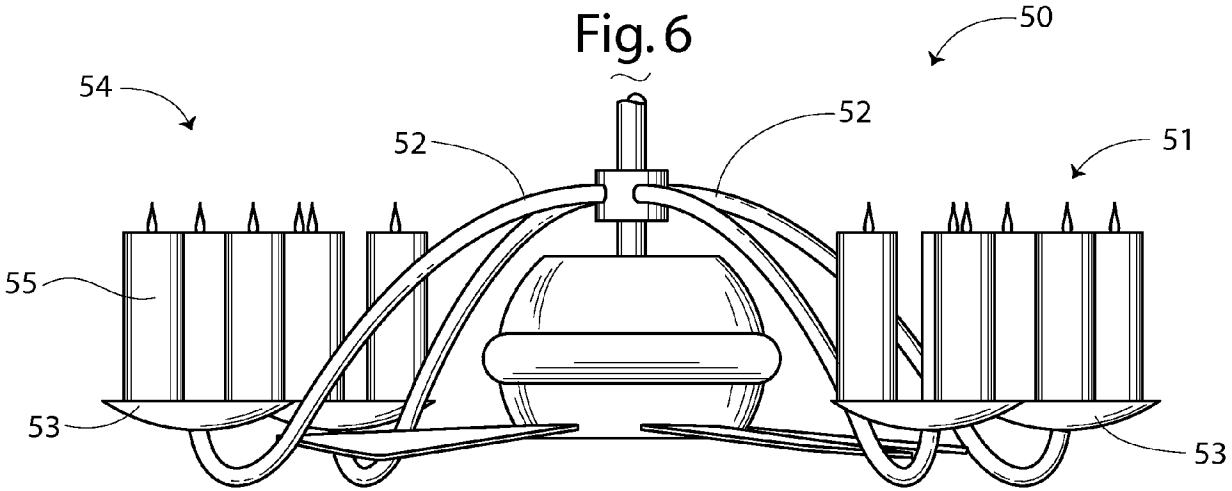
FIG. 6 is a side view, shown in partial cross-section, of a ceiling fan in another preferred embodiment.

With reference next to FIG. 6, there is shown a ceiling fan 30 in another preferred form of the invention. Here, the ceiling fan 30 is essentially the same as that previously described except for the form of the shroud 31. The shroud 31 includes a series of elongated arms 32 terminating with plates 33 which hold a side wall 34 in the form of simulated candles 34. Here again, the plates 33 and candles 35 form a barrier or screen which is intended to obscure the majority of the ceiling fan motor housing and blades from view.

Figure 7:
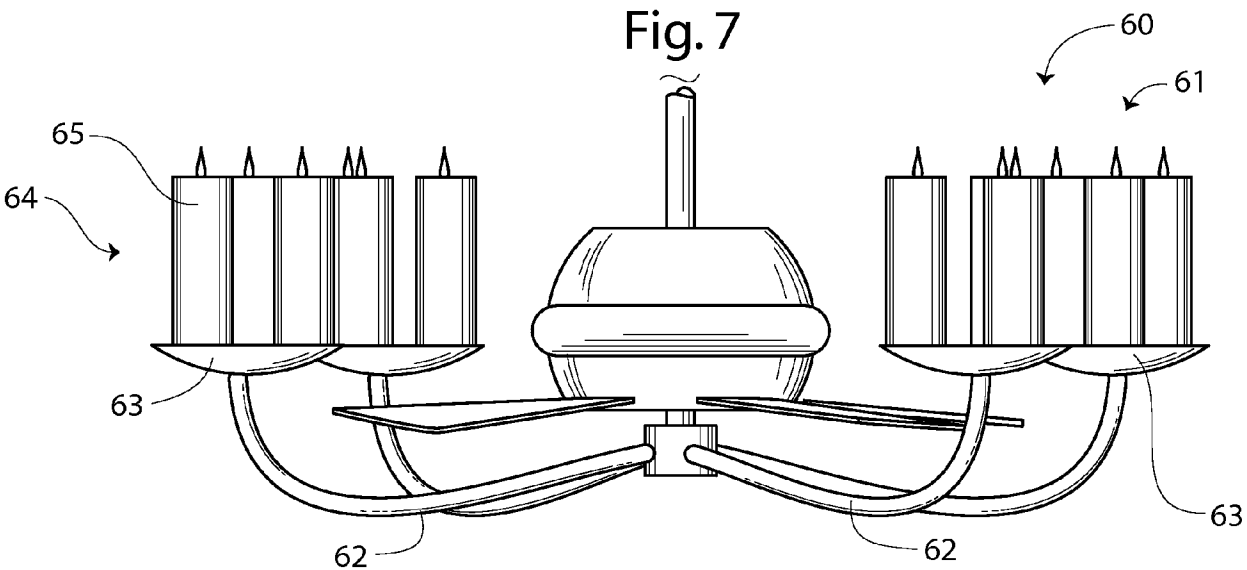
FIG. 7 is a side view, shown in partial cross-section, of a ceiling fan in yet another preferred embodiment.

With reference next to FIG. 7, there is shown a ceiling fan 40 in another preferred form of the invention. Here, the ceiling fan 40 is essentially the same as that previously described in reference to FIG. 1 except for the form of the shroud 41. The shroud 41 includes a series of elongated arms 42 extending from the bottom portion of the ceiling fan motor housing. This portion is typically coupled to a conventional ceiling fan light kit. The elongated arms 42 terminate at plates 43 which hold a side wall 44 in the form of simulated candles 45. Here again, the plates 43 and candles 45 form a barrier or screen which is intended to obscure the majority of the ceiling fan motor housing and blades from view.

It thus is seen that an improved ceiling fan is now provided which obscures the working portions of a conventional ceiling fan. While this invention has been described in detail with particular references to the preferred embodiments thereof, it should be understood that many modifications, additions and deletions, in addition to those expressly recited, may be made thereto without departure from the spirit and scope of the invention as described by the following claims.

The invention claimed is:

1. A ceiling fan comprising:

a downrod;

a motor;

a motor housing encasing said motor;

a plurality of blades coupled to said motor; and a shroud positioned about said motor housing and said plurality of blades, said shroud includes a lower plate comprising a top surface opposed to a bottom surface and a screen extending upwardly from said top surface, said screen being comprised of a plurality of upright cylinders, each cylinder having a light associated therewith, whereby the shroud obscures the motor housing and plurality of blades from view along a line of sight generally horizontal to the motor housing.

2. The ceiling fan of claim 1 wherein said blades are positioned above said bottom surface.

3. The ceiling fan of claim 1 wherein said shroud is tubular.

4. The ceiling fan of claim 1 further comprising a coupler coupled to said downrod and a plurality of arms extending between said coupler and said lower plate.

5. The ceiling fan of claim 4 further comprising a member extending between said coupler and said motor housing.

6. A ceiling fan comprising:

a downrod;

a motor coupled to said downrod;

a motor housing mounted about said motor;

a plurality of blades coupled to said motor;

a shroud positioned about said motor and said plurality of blades, said shroud having at least one lower plate comprising a top surface opposed to a bottom surface and at least one screen extending from said top surface, said screen being comprised of a series of upright cylinders;

a coupler coupled to said downrod; and a plurality of arms extending between said coupler and said at least one lower plate.

7. The ceiling fan of claim 6 wherein at least a plurality of said cylinders includes a light which resembles a flame.

8. The ceiling fan of claim 6 wherein said blades are positioned above said bottom surface.

9. The ceiling fan of claim 6 wherein said shroud is tubular.

10. The ceiling fan of claim 6 further comprising a member extending between said coupler and said motor housing.

* * * * *